United States Patent [19]

Fellner

[11] 4,187,713

[45] Feb. 12, 1980

[54] QUICK CHUCKING DIE HOLDER DEVICE FOR FORGING PRESSES

[76] Inventor: Georg Fellner, Am Tale 4, D-7203 Fridingen, Fed. Rep. of Germany

[21] Appl. No.: 894,680

[22] Filed: Apr. 10, 1978

[30] Foreign Application Priority Data

Apr. 9, 1977 [DE] Fed. Rep. of Germany ..... 2716023

[51] Int. Cl.[2] ..... B21J 13/02

[52] U.S. Cl. ..... 72/446; 72/462

[58] Field of Search ..... 72/462, 446, 447, 455; 83/698

[56] References Cited

U.S. PATENT DOCUMENTS

| | | | |
|---|---|---|---|
| 3,435,655 | 4/1969 | Akikazu | 72/462 |
| 3,638,473 | 2/1972 | McElroy | 72/462 |
| 3,762,264 | 10/1973 | Scott | 83/698 |

FOREIGN PATENT DOCUMENTS

| | | | |
|---|---|---|---|
| 253010 | 11/1970 | U.S.S.R. | 72/446 |

*Primary Examiner*—Francis S. Husar
*Assistant Examiner*—Gene P. Crosby
*Attorney, Agent, or Firm*—George R. Douglas, Jr.; Sherman Levy

[57] ABSTRACT

A quick chucking die holder device for forging presses comprises an upper and a lower die holder and two adapter plates with dies fastened therein. Centering gibs are provided for centering the adapter plates within the die holders and spring loaded wedges make the chucking connection. The wedges may be controlled by means of hydraulic cylinders, or in a modified form, by the proper ram movement thereby movement of the ram is caused to release, or to clamp, the adapter plates.

13 Claims, 12 Drawing Figures

QUICK CHUCKING DIE HOLDER DEVICE FOR FORGING PRESSES

BACKGROUND OF THE INVENTION

The invention relates to a quick chucking die holder device for forging presses having a lower die holder being fastened to the press bed and an upper die holder being fastened to the ram. Said die holders contain lower and upper die halfs which make at least two molds. The work pieces pass successively through these molds and will be formed a bit more in each mold, i.e. by each stroke of the ram.

A known quick chucking die holder device, wherein the dies are fastened by means of screws, comprises guiding posts constituting a guiding connection between the upper and lower die holder and spring loaded clamping claws for fixing them to the press bed or to the ram respectively. The clamping means may be controlled by hydraulic cylinders which are mounted in the bed and in the upright frame of the press.

With the known device, however, a certain shortening of the time needed for exchanging the dies must be purchased by important financial resources, because quite a number of costly die holder devices is needed for full utilisation of a press. Difficulties arise in preheating the cumbersome devices as the usual preheating furnaces are convenient only for receiving the dies. Moreover the die holder device would assume high temperatures and it would become difficult to transport and to handle it. The known device is not suitable for supplementary use with an already working press because constructive activities, such as the installation of hydraulic cylinders, concerning the press body are indispensable. Finally special exchange carriers or other constructively fitting transport aids must be provided for in consideration of the weight of such a die holder device.

SUMMARY OF THE INVENTION

It is an object of the invention to provide an economic die holder device which allows to exchange dies quicker as heretofore, which can be used as supplementary tool for presses already existing in a plant and which makes better products.

According to the invention there is provided at least two pairs of adapter plates containing dies, the die holders remaining in fast connecting with the press, several centering gibs arranged between the ultimate and the penultimate mold for "swimming" centering the adapter plates in the horizontal plane within the die holders and spring-loaded chucking wedges received in recesses of the die holders and acting on the adapter plates.

BRIEF DESCRIPTION OF THE DRAWINGS

The invention will be described in greater detail, by way of example, with reference to the drawings in which.

DESCRIPTION OF THE PREFERRED EMBODIMENTS

Figure 1:
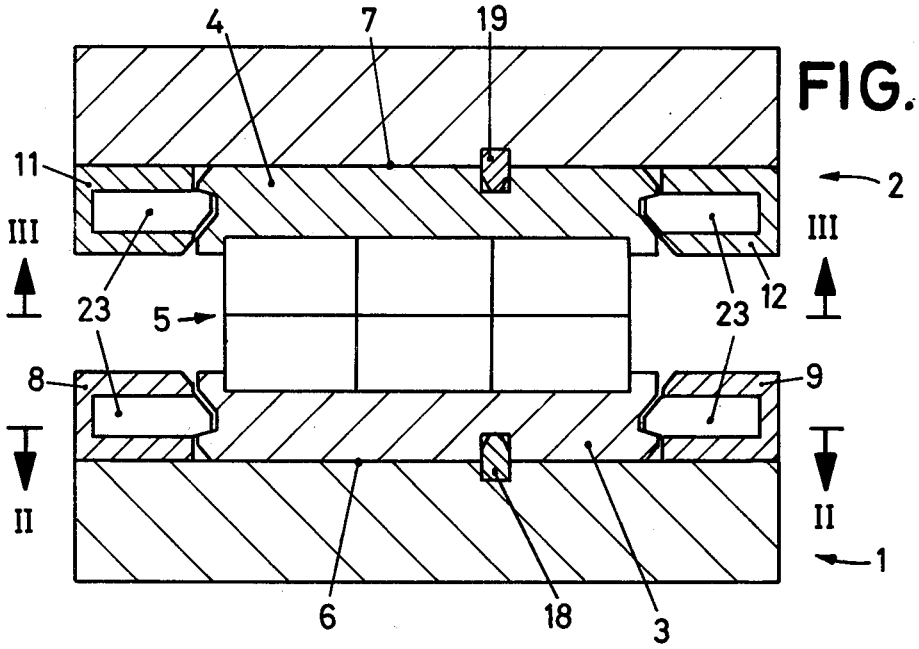
FIG. 1 is a cross-sectional view of a die holder device with inserted adapter plates and dies.
Figure 2:
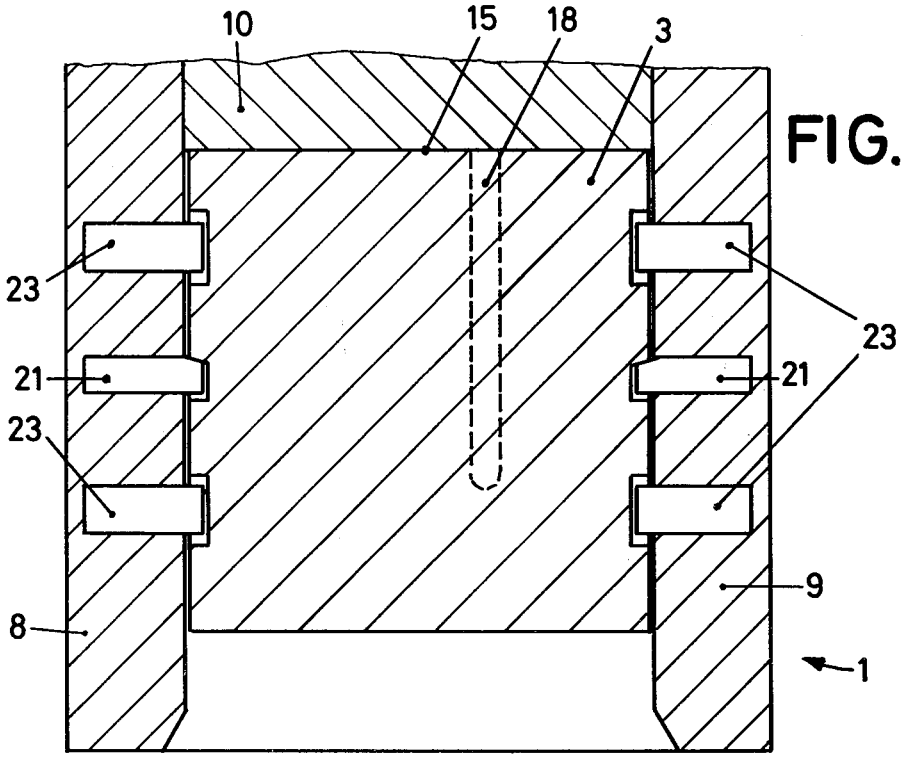
FIG. 2 is a sectional view taken horizontally along lines II—II of the lower die holder with its adapter plate.
Figure 3:
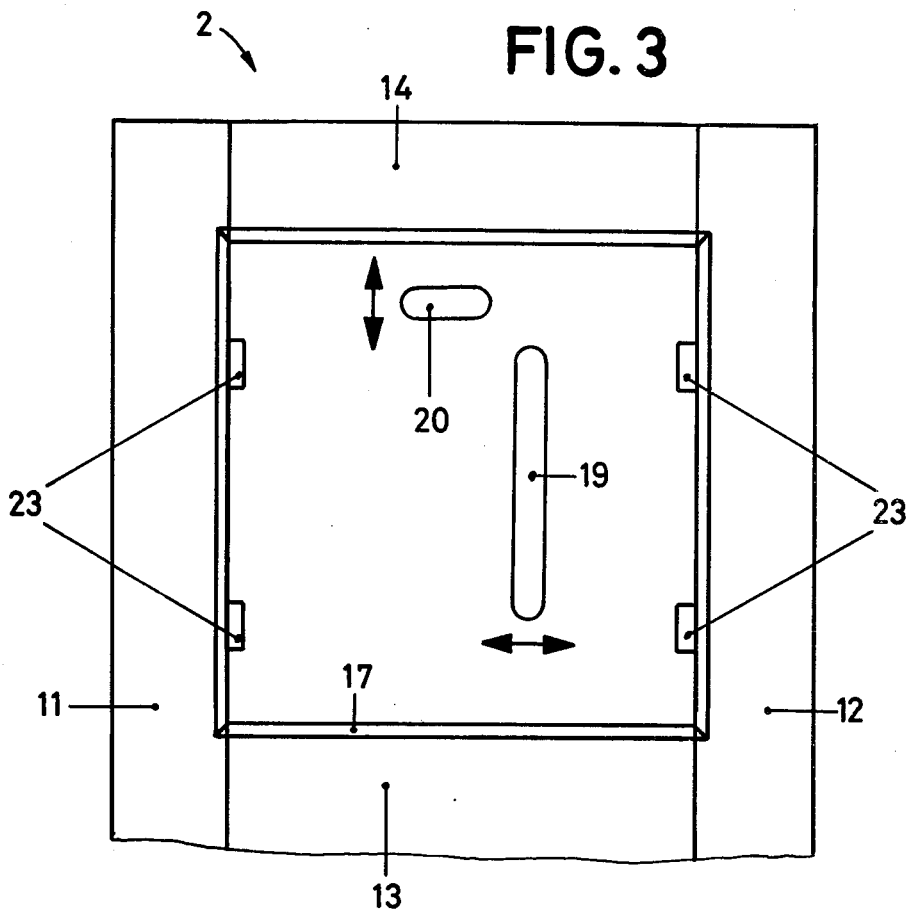
FIG. 3 is a view taken along lines III—III of the upper die holder showing the inner side without the adapter plate.
Figure 4:
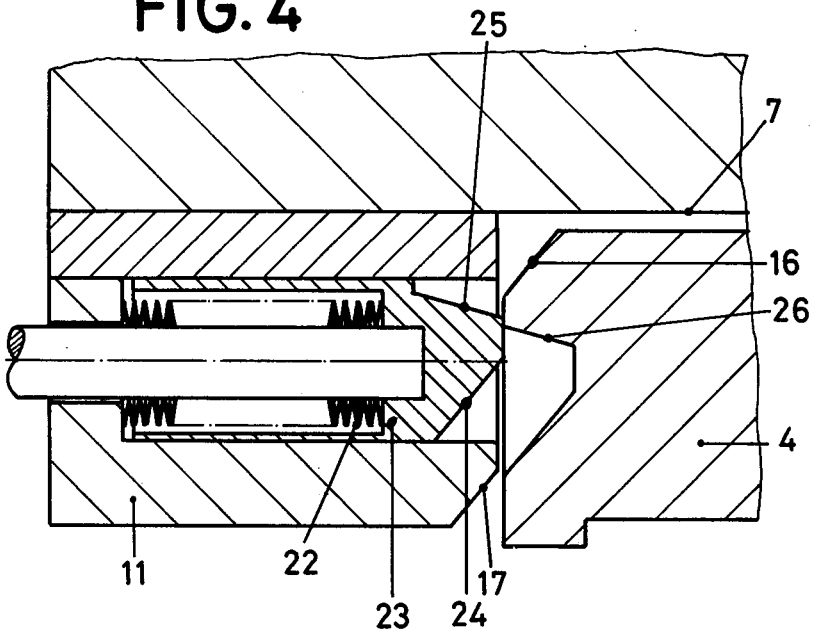
FIG. 4 is a sectional view similar to FIG. 1 showing the left upper portion in detail during insertion of the adapter plate just before chucking.
Figure 5:
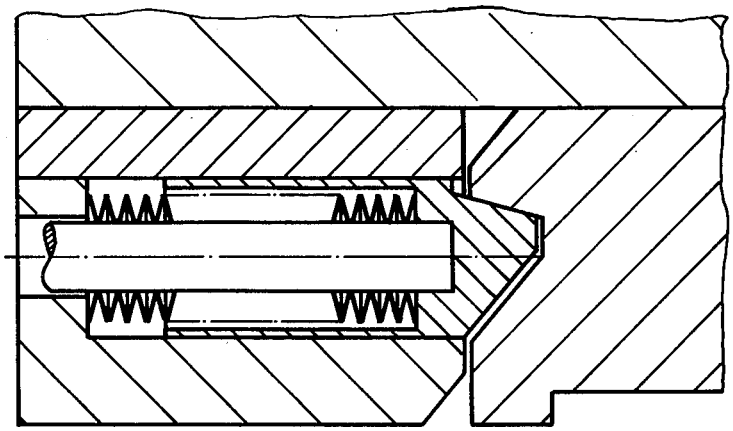
FIG. 5 is a view similar to FIG. 4 in chucked position.
Figure 6:
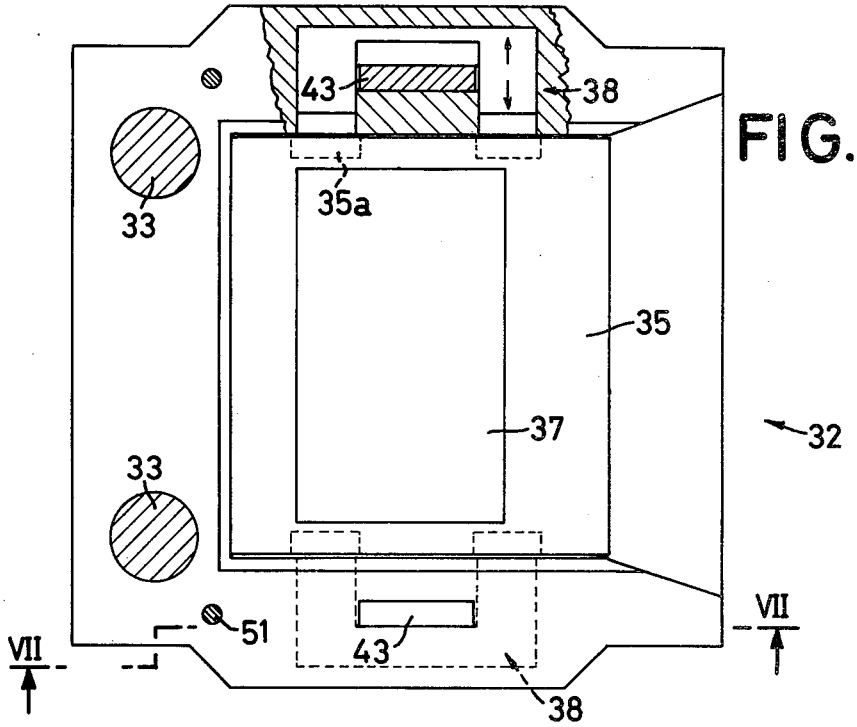
FIG. 6 is a top plan view of a modified lower die holder showing intruded retracting wedges, i.e. retracted chucking wedges.

Basically the invention proposes that not the whole die holder device but only the adapter plates with the dies contained therein will be exchanged. The adapter plates are relatively small and therefore not expensive and to handle without difficulties. They may be preheated in a usual preheating furnace. All the chucking means are built-in such as the new die holder device is a supplement for presses which used heretofore other die holder devices.

The centering of the adapter plates takes place in two steps. The first step is a coarse centering by means of borders with bevelled inner edges. Sliding with their own bevelled edges along said inner edges the adapter plates "find" the receiptive hollows of the die holders even if previously they had been considerably shifted in horizontal direction. It is, however, important that the adapter plates have all around sufficient clearance for expansion as a result of heating up during forging. Moreover it is an important feature that the centering gibs and the grooves receiving these gibs are arranged near the ultimate mold, that is the mold defining the ultimate form of the work piece. Different heat expansion of the upper and lower die is unavoidable. But centering near the ultimate mold ensures that the greatest shift of the dies appears in the area of the first molds whereas shift in the area of the ultimate mold is minimized. So the effect of temperature variations on die shifting is practically eliminated.

The centering gibs may be transversely adjustable by means of screwed spindles accessible and operable from the operating front. This feature is advantageous during preliminar adjustment as well as during production work. An exact correction will be achieved at once since the number of screw revolutions may be calculated with some experience on the basis of the produced work piece. It has been found that the readjustment is done so quickly that the workpiece preheating furnace must not be switched off.

For the rear end of the lower adapter plate may be provided a limiting surface instead of a centering gib disposed in parallel relation to the operating front. Latching wedges acting horizontally press the adapter plate against this limiting surface. This feature simplifies the insertion of the tool set, i.e. the adapter plates, into the lower die holder because the inserting movement is not vertical but horizontal in a sliding manner.

Another preferred embodiment of the invention uses the proper ram movement for retracting and moreover controlling the chucking and/or latching wedges instead of special hydraulic cylinders. This decreases the purchase costs of the die holder device and ensures better reliability in operation than is given when hydraulic auxiliary installation is used.

The following contemplation with regard to constructional details of this embodiment refers to the chucking wedges acting in vertical direction as well as to the latching wedges acting in horizontal direction. In order to simplify matters, the following description is directed only on chucking wedges.

As a substantial feature the invention provides retracting wedges co-acting with the chucking wedges by means of inclined surfaces. Preferably the arrangement is made in such a way that the retracting wedges not only move the chucking wedges against the action of their springs, but also retain them in their retracted position without any further external intervention. It is therefore proposed to use retracting and chucking wedges having additional co-acting surfaces which are adjacent to the aforementioned inclined surfaces, the additional surface of the chucking wedge being square to its direction of motion. When the retracting wedge is forced in, as soon as the inclined surfaces have slided apart, it is clamped fast like a crossbar by the spring-loaded chucking wedge, the respective additional surfaces bearing on each other.

If the retracting wedges are movable in vertical direction this simplifies matter essentially. As to this case the invention provides thrust supports which may be inserted between the retracting wedges of the upper and lower die holder so as to intrude the retracting wedges by the downstroke of the ram. During this downstroke both die holders approach each other. There will be no difficulties caused by different intrusion forces for the upper and lower retracting wedges if the thrust supports are constructed in such a way that they rest upon the relative die holder after the intrusion of a retracting wedge, thus limiting the intrusion movement of that retracting wedge. In order to avoid any damages of the thrust supports or the press, if due to the mounting of smaller dies the lower reversal point space of the press had been altered in height, it is provided to make each thrust support consisting of two parts which are clamped together in an overlapping way, thus permitting to shift over each other against the action of the clamping friction in case of exaggerated ram thrust and allowing a safe shortening of the thrust support.

In order to release the retracting wedges it is provided to arrange two-armed rockers underneath the retracting wedges of the lower die holder and above the retracting wedges of the upper die holder. One arm of each rocker bears against the retracting wedge and the other arm bears against a release tappet which is guided in the die holder in a vertically slidable way. If this release tappet is pressed in, the rocker extrudes the retracting wedge. Employing thrust pieces attachable to the release tappets in order to elongate them, makes it possible to press the release tappets in by the downstroke of the ram, whereby a firm chucking of the dies is effected.

A preferred variation of this embodiment of the invention provides a co-axial arrangement of the corresponding release tappets of both die holders and thrust pieces to be disposed between them. Moreover there are provided spring elements pressing down the release tappets of the upper die holder. These spring elements—preferably also cup spring packets—are adapted to release first the lower retracting wedges and only thereafter the upper retracting wedges during the downstroke of the ram. This selected succession avoids incidentally chucking the lower die only on the left and the upper die only on the right side, which would cause an overload of the centering gibs mounted within the die holders. The spring elements, however, enforce a bilateral chucking, first of the lower and then of the upper die.

With the aid of different thrust pieces it is also possible to release by choice the retracting wedges of the upper or of the lower die holder individually. These thrust pieces permit a closer distance between the two release tappets and they rest in the one case upon the lower and in the other case upon the upper die holder.

Referring now to the drawings in the embodiment shown in FIGS. 1–5 the die holder device comprises a lower die holder 1 and an upper die holder 2. Each die holder contains an adapter plate 3, 4 on which is fastened a set of dies 5. The die holders comprise a base plate giving contact surfaces 6, 7 for the adapter plates 3 and 4 respectively and borders 8 to 14. On the operation front side (lower side in FIG. 2) the lower die holder has no border such as the lower adapter plate 3 may be pushed in to abut against a limiting surface 15 of the backward border 10. The horizontal distance between the borders is great enough so that always remains an expansion joint between the adapter plates and the borders.

In order to center the adapter plates in a coarse preliminar way during insertion in a vertical direction there are provided bevelled edges 16 co-acting with similar bevelled edges 17 on the inner sides of the borders. Fine centering takes place by means of transversely adjustable centering gibs 18 to 20, these being lowered within the base plates and protruding partly over the contact surfaces 6 and 7. Only one centering gib 18 is mounted within the lower die holder 1, the lower adapter plate, however, will be pressed against the limiting surface 15 by means of latching wedges 21. Moreover there are mounted chucking wedges 23 (shown schematically) which are spring-loaded by means of cup springs 22. The chucking wedges have an inclined surface 24 of greater angle of inclination and an inclined surface 25 of minor angle of inclination. The surfaces 25 co-act with chucking surfaces 26 of the adapter plates.

In operation the exchange of the adapter plates takes place as follows. When the ram is in its lowermost position built-in hydraulic cylinders (not shown) retract the latching and chucking wedges 21 and 23. The ram is now brought into its uppermost position and the tool set comprising both adapter plates 3 and 4 and the die set 5 is carried away by means of a fork lift track. Then another tool set with new dies will be inserted from the operation front side or from above. In the latter case it will be coarse centered by the bevelled edges 16, 17. The centering gib 18 effects fine laterally centering. Now the hydraulic cylinders will be released. The leading latching wedges 21 press the adapter plate 3 against limiting surface 15 for fine centering it at right angles to the centering gib 18. Finally the chucking wedges 23 go in their chucking position such fixing the adapter plate 3.

As the chucking wedges 23 of the upper die holder are released too, the upper adapter plate 4 may now be centered and chucked by one downstroke of the ram. During this downstroke by slow motion control the adapter plate 4 moves into the upper die holder 2 thereby being coarse centered by means of bevelled edges 16, 17 on all four sides. Then fine centering follows by action of centering gib 19 in lateral direction and by action of centering gib 20 in a direction perpendicular to the operation front. Moreover the bevelled edges 16 co-acting with inclined surfaces 24 press the chucking wedges 23 back until these get free just before the lowermost position of the ram and chuck the upper adapter plate 4 too.

In order to equalize a lateral dislocation of the dies the ram is first moved in the lowermost position. Then the upper chucking wedges 23 are loosened, i.e. retracted by means of the hydraulic cylinders. Next the upper adapter plate 4 may be adjusted by means of centering gibs 19 and 20 moved with a screw spanner from the operating front side. Releasing the hydraulic cylinders makes the adapter plate 4 chucked again. The ram may be moved upwards again and production may be continued at once.

The die holder device of the other embodiment shown in FIGS. 6–12 consists of an upper die holder 31 and a lower die holder 32 which are guided on each other by means of two guiding posts 33. An upper and a lower adapter plate 34 and 35 are chucked within the respective die holders and contain dies 36 and 37.

In the die holders are mounted two U-shaped chucking members 38 (FIG. 9) which are—as demonstrated by arrows—slidable in transverse direction seen from the operating side.

The U-shaped chucking members consist of two chucking wedges 39 connected by a web portion 40. The shape of the front parts of the chucking wedges which engage the adapter plates 34 and 35 is now described more in detail.

Figure 11:
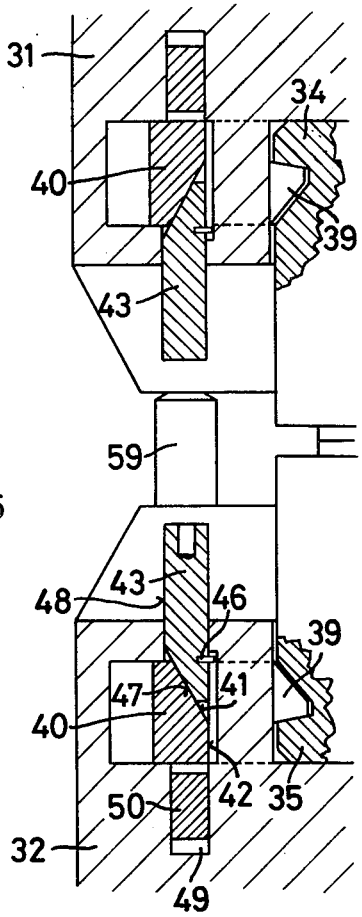

The front parts as shown in FIG. 11 have two inclined surfaces each with different angles of inclination. The adapter plates 34 and 35 are provided with recesses 35*a* to receive these front parts of the chucking wedges. The chamfered edges of the adapter plate coact with the surfaces of greater angle of inclination of the wedges whereas the surfaces of minor angle of inclination of the wedges bear against the surfaces of same inclination within the recesses so as to chuck the adapter plates onto their respective die holders in vertical direction.

Figure 8:
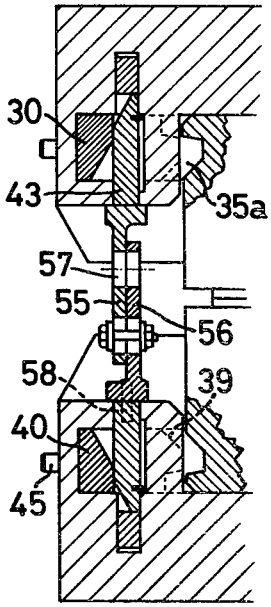
FIG. 8 is a sectional view taken along the line VIII—VIII of the arrangement of FIG. 7.

At web portion 40 of the U-shaped chucking member distinction has to be made between wedge surface 41 and latching surface 42, the latter being perpendicular to the direction of motion, both surfaces are co-acting with retracting wedges 43. Each chucking wedge 39 contains a cup spring packet 44 which is penetrated by a guide bolt 45. The retracting wedges 43 are mounted in the die holders 31 and 32 in a vertically slidable way, i.e. transverse to the direction of motion of the U-shaped chucking members 38. The end positions of the chucking and retracting wedges are shown in FIGS. 8 and 11. Stop pins 46 prevent the retracting wedges from slipping out. One wedge surface 47 and one latching surface 48 of each retracting wedge 43 co-act with the relative surfaces 41 and 42 at the web portions 40 of the U-shaped chucking members 38.

Underneath or above the retracting wedges 43 respectively freely moving, boomerang-like rockers 50 are placed into suitable dimensioned hollows 49 of the die holders. These rockers rest on one side upon the relative retracting wedge 43 and on the other side upon vertically slidable release tappets 51, 52. These tappets are mounted coaxially facing each other. The lower release tappets 51 project, even if the retracting wedge is released, over the top surface of the lower die holder 32 and center the thrust pieces which will be described above. The upper release tappets 52 are pressed down by cup springs 53, which are contained in the adequately enlarged lower part of the relative boreholes in the die holder.

Figure 7:
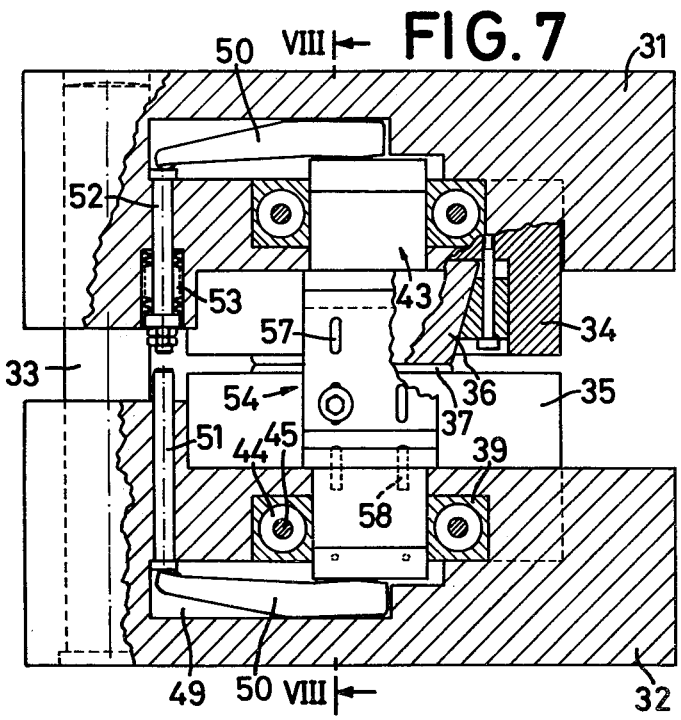
FIG. 7 is a sectional view of modified two-piece die holder device taken along the line VII—VII and also showing intruded retracting wedges.

The thrust support 54 serve for the intrusion of the retracting wedges, one of them is shown in FIGS. 7 and 8. Each thrust support consists of two plates 55 and 56 having on their upper and lower parts enlarged supporting edges and being screwed together in an overlapping way. The holes of the connecting screws are oblong holes 57 going in vertical direction. In order to permit an exact positioning of the thrust supports when the die holders are moved apart, the lower supporting edge is equipped with centering pins 58, enabling the thrust supports being inserted into corresponding receiptive boreholes of the lower retracting wedges 43.

Figure 10:
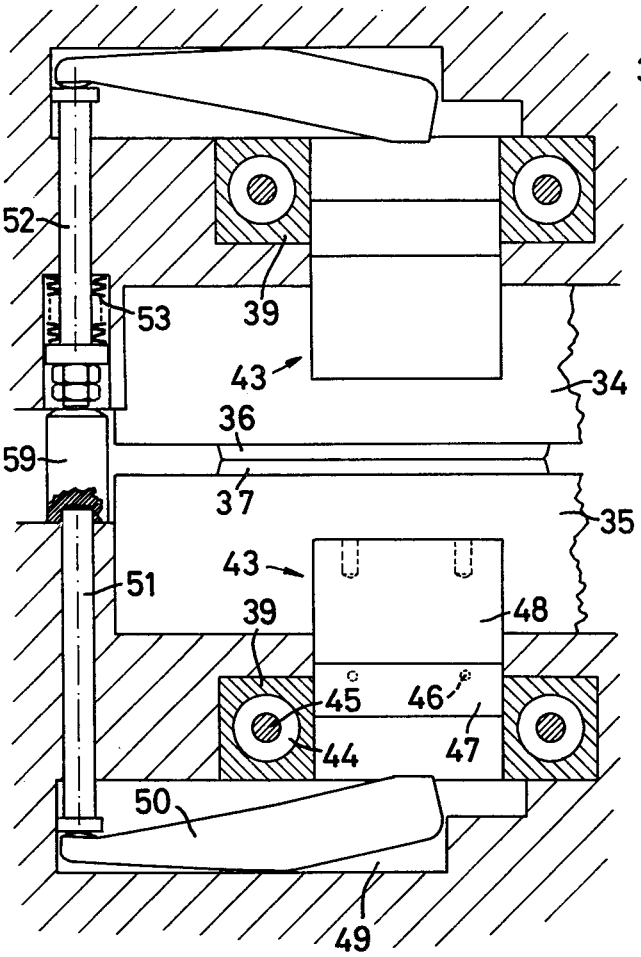
FIGS. 10 and 11 are views drawn on an enlarged scale with reference to FIGS. 7 and 8, showing released retracting wedges, i.e. chucking wedges in chucked position.
Figure 12:
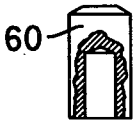
FIG. 12 shows a thrust piece different to that shown in FIG. 10 and adapted to release the upper retracting wedges only.
Figure 9:
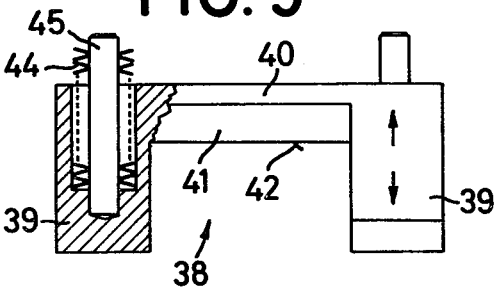
FIG. 9 is a top plan view of the employed U-shaped chucking member partly broken away.

FIGS. 10 and 12 finally show thrust pieces 59 and 60 which may be slipped on the lower release tappets 51, whereby thrust piece 59 has a shorter and thrust piece 60 has a deeper borehole. The outside diameter of these cylindric thrust pieces which have a bevelled top side is designed as to enable a slack insertion into the enlarged lower part of the receiptive borehole of the upper die holder.

In operating an exchange of the dies is executed with the aid of the described quick chucking die holder in the following way: When the ram together with the upper die holder 31 is moved up (this position is not shown), the two thrust supports 54 are slipped on the lower retracting wedges 43. Now the downstroke of the ram is actuated by the slow motion control of the press. Consequently first the upper retracting wedges place upon the upper surfaces of the thrust supports 54. During the further motion the lower as well as the upper retracting wedges are intruded so that the U-shaped chucking members 38 move backwards against the action of cup springs 44 loosening thus the adapter plates 34 and 35. As soon as the wedge surfaces 41 and 47 have slided apart, the latching surfaces 42 and 48 of the U-shaped chucking member 38 and of the retracting wedge 43 rest upon each other, so that the retracting wedges in their final position—as shown in FIG. 8—firmly interlock the U-shaped chucking members. In order to avoid any damage of the thrust supports 54 or other troubles caused by altered die space, both plates 55 and 56 of the supports are movable towards each other to a certain extent.

The upper die holder is moved up again and the supports 54 are removed. The upper adapter plate 34 with the upper die 36 remain reposing upon the lower adapter plate 35 and the lower die 37, making it thus possible to remove the whole die from the press.

For installation of other adapter plates with new dies two thrust pieces 59 with short boreholes are slipped on the two lower release tappets 51. If now the upper die holder 31 again is stroken down by the slow motion control, the upper release tappets 52 abut on the thrust pieces 59, and during further motion first the lower release tappets 51 are pressed in, as the cup springs 53 augment the force which is necessary to press the upper release tappets 52 in. The intrusion of the release tappets 51 effects a tipping movement of the lower rockers 50. They press with their opposite arms the lower retracting wedges 43 upwards, whereby it is sufficient to separate at least the latching surfaces 42 and 48. Now the action of the cup springs 44 of the U-shaped chucking members 38 takes place. The chucking wedges 39 engage the lower adapter plate 35 and chuck it firmly down, whereby simultaneously and by means of the wedge surfaces 41 and 47, the lower retracting wedges 43 are moved further upwards.

As soon as the thrust pieces 59 rest upon the lower die holder 32 during the downstroke of the ram, the further motion includes the upper release tappets 52 into the upper die holder 31 against the action of cup springs 53. Now the same process as described will take place in a mirror-inverted way. The upper rockers 50 press the upper retracting wedges 43 downwards so as to release them. The upper U-shaped chucking members 38 thus chucking the upper adapter plate 34 firmly. Thereafter the upstroke of the ram may be executed and the two thrust pieces 59 may be taken out. Production may be continued immediately.

If instead of the thrust pieces 59 the thrust pieces 60 are installed, the lower release tappets 51 remain unaffected so that only the upper adapter plate 34 is chucked. A requirement of this kind often emerges if, for example, the lower adapter plate 35 only has to be removed to enable necessary reworks due to wear phenomena of the lower die 37. In this case the upper adapter plate 34 and the die 36 contained therein, need not to be removed.

It will be understood that the above discription of the present invention is susceptible of various modifications changes and adaptations.

I claim:

1. In a quick chucking die holder device for forging presses having a lower die holder for fastening to the press bed and an upper die holder for fastening to the ram, said die holders containing lower and upper dies making at least two molds so as to form individual work pieces successively by one stroke of the ram each, the improvement comprising a lower and an upper adapter plate containing said dies in fast relation, centering gibs for transversely centering said adapter plates within said die holders in horizontal directions, said centering gibs fitting into centering grooves and being arranged between the ultimate and penultimate mold, borders being disposed on the die holders and embracing the adapter plates at least on two sides, the horizontal distance between said borders being great enough to provide an expansion joint between said borders and said adapter plates, bevelled inner edges provided on the borders and co-acting with similar bevelled edges of said adapter plates for centering same in a coarse manner during insertion, and spring-loaded horizontally movable chucking wedges in the borders, said wedges having each an inclined surface of greater angle of inclination co-acting with said bevelled edges of said adapter plates and an inclined surface of minor angle of inclination co-acting with chucking surfaces of said adapter plates to thereby clamp said adapter plates onto said die holders.

2. The invention defined in claim 1 and further including a limiting surface disposed in parallel relation to the operating front on the lower die holder for limiting the rear end of said lower adapter plate and latching wedges slidably mounted in the lateral borders for pressing said lower adapter plate against said limiting surface, said latching wedges having a leading movement in comparison with said chucking wedges.

3. The invention definded in claim 1 wherein said centering gibs enter from the operating rear.

4. The invention defined in claim 1 wherein said wedges are retractable by the proper ram movement.

5. The invention defined in claim 4 and further including retracting wedges co-acting with said chucking wedges by means of inclined surfaces.

6. The invention defined in claim 5 wherein said retracting and chucking wedges have co-acting latching surfaces adjacent to the inclined surfaces, the chucking wedge in the retracted position bearing with the latching surface on the latching surface of the retracting wedge which acts as a cross-bar to movement of the chucking wedge.

7. The invention defined in claim 6 wherein said retracting wedges are movable in vertical direction and thrust supports are arranged to be inserted between the retracting wedges of the upper and lower die holders so as to intrude and actuate the retracting wedges by the downstroke of the ram.

8. The invention defined in claim 7 wherein said thrust supports comprise two parts clamped together in an overlapping way.

9. The invention defined in claim 5 wherein two-armed rockers are arranged underneath the retracting wedges of the lower die holder and above the retracting wedge of the upper die holder so that one arm of a certain rocker bears against a retracting wedge in releasing direction when the ram during downward motion bears against the other arm by means of a release tappet guided slidably in a borehole of the die holder.

10. The invention defined in claim 9 wherein thrust pieces are provided to be attached onto the release tappets as to elongate them.

11. The invention defined in claim 10 wherein the corresponding release tappets of both die holders are arranged co-axial, said thrust pieces are disposable between them and spring elements press down the release tappet of the upper die holder.

12. The invention defined in claim 11 wherein different thrust pieces are provided for selectively releasing at least one retracting wedge.

13. The invention definded in claim 12 wherein two chucking wedges being arranged one beside the other and connected by a web portion form a U-shaped chucking member and the belonging retracting wedge co-acts with an inclined surface of the web portion.

* * * * *